US010247410B2

(12) United States Patent
Bettinzoli

(10) Patent No.: US 10,247,410 B2
(45) Date of Patent: Apr. 2, 2019

(54) GAS BURNER

(75) Inventor: Angelo Bettinzoli, Concesio (IT)

(73) Assignee: SABAF S.P.A., Ospitaletto (BS) (IT)

( * ) Notice: Subject to any disclaimer, the term of this patent is extended or adjusted under 35 U.S.C. 154(b) by 685 days.

(21) Appl. No.: 13/990,141

(22) PCT Filed: Dec. 22, 2010

(86) PCT No.: PCT/IB2010/003324

§ 371 (c)(1),
(2), (4) Date: Apr. 14, 2014

(87) PCT Pub. No.: WO2012/085610

PCT Pub. Date: Jun. 28, 2012

(65) Prior Publication Data

US 2014/0209088 A1 Jul. 31, 2014

(51) Int. Cl.
*F23D 14/06* (2006.01)

(52) U.S. Cl.
CPC .... *F23D 14/06* (2013.01); *F23D 2900/14062* (2013.01)

(58) Field of Classification Search
CPC ..... F23D 14/06; F23D 2900/14062; F23D 14/10; F23D 2900/14001
USPC ..... 431/354, 284
See application file for complete search history.

(56) References Cited

U.S. PATENT DOCUMENTS 3,959,866 A * 6/1976 Biddle ..... C23D 15/00 29/446
4,035,132 A * 7/1977 Smith ..... F23D 14/16 431/328
4,793,321 A * 12/1988 Rafford ..... F23D 3/02 126/43
5,639,232 A * 6/1997 Bogenschutz ..... F23D 14/065 126/39 E
5,842,849 A * 12/1998 Huang ..... F23D 14/06 126/39 R (Continued)

FOREIGN PATENT DOCUMENTS

CN 2658584 Y 11/2004
EP 0 903 538 A1 3/1999

(Continued)

OTHER PUBLICATIONS

International Search Report and Written Opinion of PCT/IB2010/003324 dated Sep. 26, 2011.

*Primary Examiner* — Kenneth Rinehart
*Assistant Examiner* — Deepak A Deean
(74) *Attorney, Agent, or Firm* — Lucas & Mercanti, LLP

(57) ABSTRACT

Gas burner of the type having a cup of the burner accommodating at least one injector for fuel gas, a head of the burner coupled to the cup and including at least one distribution chamber for a first circumferential flame spreader, a mixing chamber for mixing primary air and fuel gas to set up a fuel mixture, the mixing chamber being fluidically connected to the cup and an injector, a duct for transferring the fuel mixture from the mixing chamber into the distribution chamber, and inflow duct of the primary air from the outer environment inside the cup of the burner, as well as a separating element of the transferring duct of the fuel mixture from the inflow duct of the primary air, wherein the separating element could be tightly constrained to the head, or cup of the burner.

19 Claims, 4 Drawing Sheets

(56) References Cited

U.S. PATENT DOCUMENTS 6,035,846 A * 3/2000 Saleri ..... F23D 14/06 126/39 H
6,132,205 A * 10/2000 Harneit ..... F23D 14/06 126/39 E
6,263,868 B1 * 7/2001 Koch ..... F23D 14/06 126/39 E
6,325,619 B2 * 12/2001 Dane ..... F23D 14/065 126/39 E
6,332,460 B1 * 12/2001 Paesani ..... F23D 14/06 126/39 R
6,349,714 B1 * 2/2002 Hurley ..... F24C 3/103 126/21 R
6,607,378 B2 * 8/2003 Harneit ..... F23D 14/06 126/39 E
8,221,116 B2 * 7/2012 Biagioli ..... F23D 14/065 126/39 BA
2001/0010897 A1 * 8/2001 Dane ..... F23D 14/065 431/266
2003/0000512 A1 * 1/2003 Moresco ..... F23D 14/06 126/1 R
2004/0029063 A1 * 2/2004 Bettinzoli ..... F23D 14/065 431/354
2004/0234915 A1 * 11/2004 Koch ..... F23D 14/065 431/278
2005/0095547 A1 * 5/2005 Pottenger ..... F23C 5/02 431/354
2005/0145239 A1 * 7/2005 Bettinzoli ..... F23D 14/06 126/39 E
2006/0051718 A1 * 3/2006 Kamal ..... F23D 14/06 431/354
2006/0121402 A1 * 6/2006 Bettinzoli ..... F23D 14/06 431/354
2007/0059654 A1 * 3/2007 Armanni ..... F23D 14/06 431/8
2007/0141521 A1 * 6/2007 Armanni ..... F23D 14/06 431/354
2007/0218414 A1 * 9/2007 Harneit ..... F23D 14/06 431/354
2008/0206697 A1 * 8/2008 Trochou ..... F23D 14/06 431/284
2009/0047611 A1 * 2/2009 Armanni ..... F23D 14/065 431/284
2010/0089384 A1 * 4/2010 Lnzaghi; Enzo ..... F24C 3/085 126/39 E
2010/0163013 A1 * 7/2010 Serenellini ..... F23D 14/065 126/39 E
2010/0186730 A1 * 7/2010 Cadeau ..... F23D 14/06 126/39 E
2010/0319677 A1 * 12/2010 Lacche ..... F23D 14/06 126/39 E
2011/0120445 A1 * 5/2011 Armanni ..... F23D 14/06 126/39 E
2011/0151385 A1 * 6/2011 Lona Santoyo ..... F23D 14/06 431/2
2011/0232628 A1 * 9/2011 Bettinzoli ..... F23D 14/06 126/39 E
2014/0190467 A1 * 7/2014 Cadima ..... F23D 14/06 126/39 E
2014/0238384 A1 * 8/2014 Cadima ..... F23D 14/06 126/39 E

FOREIGN PATENT DOCUMENTS

EP 1 297 281 B1 10/2006
EP 1 563 225 B1 3/2010
EP 2 226 560 A2 9/2010
WO 02/02991 A1 1/2002
WO 2004/044490 A1 5/2004
WO WO 2006117815 A1 * 11/2006 ..... F23D 14/065

* cited by examiner

GAS BURNER

CROSS-REFERENCE TO RELATED APPLICATION

This application claims the benefit of PCT/IB2010/003324, filed Dec. 22, 2010, the contents of which are incorporated herein by reference.

FIELD OF THE INVENTION

The present invention concerns to an atmospheric gas burner, that is of the type wherein the primary air is drawn into a burner from the outer environment through inflow ducts, which is provided with at least one circumferential flame spreader associated with a corresponding chamber for the distribution of the fuel mixture, the latter being in turn fluidically connected with a corresponding mixing chamber, through convenient ducts.

BACKGROUND OF THE INVENTION

Atmospheric gas burners are known that are made reciprocally coupling the head and the cup of the same burner so that to define both a mixing chamber for mixing primary air and gas, in order to obtain a fuel mixture, and a distribution chamber for supplying a circumferential flame spreader with said fuel mixture. In addition, it is known to obtain, using a substantially flat separating element disposed between the head and the cup of the burner, at least two overlapped ducts, one of them being intended for allowing the primary air inflow into the burner cup, and the other for allowing the air transferring from the mixing chamber to the distribution chamber of the burner. That causes the mould shape for realizing the head and cup of the burner to be extremely geometrically simple.

It has to be observed that, herein and after, with the term "duct" it has to be intended not only substantially cylindrical tubular ducts, opened at the two bases, but further any other channeling type, having any shape or any characteristic, being able to contain and allow the fluid or fluid mixture passing therethrough.

For example, the Patent Application EP-A-1297281 in the name of the Applicant, describes a gas burner of the type comprising a burner cup being able to accommodate an injector for the fuel gas, a burner head coupled to said cup and comprising a distribution chamber for a first circumferential flame spreader, and a mixing chamber for mixing primary air and fuel gas to set up a fuel mixture. In addition, said burner comprises a plurality of ducts for transferring the fuel mixture from said mixing chamber to said distribution chamber, an equal number of inflow ducts of the primary air from the outer environment into said burner cup, as well as a flat separating element, having a cross shape, disposed between the afore mentioned transferring and primary air inflow ducts. Such a separating element is blocked between the head and cup of the burner, once the head is rested and fixed on the cup, thereby allowing the functioning thereof for separating the burner inner space and as a result for obtaining one or more primary air inflow ducts and an equal number of reciprocally overlapped ducts for transferring the fuel mixture.

This solution, as afore mentioned, although allows to simplify the mould shapes for obtaining the head and cup of the burner, together with the fact also to ensure the realization of the separating element by simple shearing, it is not free of drawbacks.

As the Applicant has been able to verify, the efficiency of such a burner is somewhat reduced because of the turbulences that are created along the path followed by the fuel mixture inside the burner. This is also a consequence of the fact that the flows of air and fuel gas generated within the ducts for transferring the fuel mixture of the burner suffer from light leakages, which inevitably occur in burner itself.

Further, such leakages of fuel mixture, in the particular structure of the burner above described having the ducts for transferring the mixture overlapping the primary air flow ducts and kept apart from them by the afore said separating plane, involve as well the fact that the mixture eventually leaking from such transferring ducts is drawn, but only slightly, with the primary air towards the mixing chamber of the burner, where it results in an incomplete mixture of gas coming from the injector with the primary air, and then, again, in a reduced efficiency of the burner.

Object of the present invention is then to increase the afore described burner efficiency, thereby minimizing the turbulence of the fuel mixture and anyway maintaining unchanged the geometrical characteristics of the burner head and cup.

Further object of the present invention is also to obtain a burner being structurally simple and easy to assembly.

SUMMARY OF THE INVENTION

These and other objects are obtained from the present gas burner of the type comprising a cup of the burner accommodating at least one injector for fuel gas, a head of the burner coupled to said cup and comprising at least one distribution chamber for a first circumferential flame spreader, at least one first mixing chamber for mixing primary air and fuel gas to set up a fuel mixture, said at least one first mixing chamber being fluidically connected to said cup and said at least one injector, at least one duct for transferring the fuel mixture from said at least one first mixing chamber into said at least one distribution chamber, and at least one inflow duct of the primary aft from the outer environment inside said cup of the burner, as well as at least one separating element of said at least one transferring duct of the fuel mixture from said at least one inflow duct of the primary air, characterized in that said at least one separating element could be tightly constrained to said at least one head, or said at least one cup of the burner.

Substantially, the use of a preferably flat, separating element, therefore obtainable by simple shearing, and tightly constrained to the burner head or cup, allows to surprisingly increase the burner efficiency, because it prevents any leakages of primary air and fuel gas through the transferring duct of fuel mixture and the inflow duct of primary air. In such a way, surprisingly, the turbulences previously detected in the known art burners are reduced, thereby obtaining a highly efficient combustion.

In addition, always according to the invention, said at least one separating element comprises a plate.

Such a plate may be constrained by welding, or forcing (by interlocking or interference) to said head or said cup.

Alternatively, said at least one separating element is removably constrained to said head, or said cup. For example, said at least one separating element is constrained by riveting, or threaded elements, to said head, or said cup; or it is constrained—preferably—by interference with said head, or said cup, otherwise it is further constrained by deformation to said head, or said cup. Always according to the invention, said at least one separating element is made of steel, or aluminum, it has a preferably rectangular shape and is obtained by sheet shearing.

Finally, according to the embodiment herein illustrated, the burner comprises a further central flame spreader combinable with said head to define, together with a higher covering element, at least one second distribution chamber for said central flame spreader. Said at least one second distribution chamber is fluidically connected with a second mixing chamber and a corresponding injector.

According to the embodiment herein described, the afore said at least one second distribution chamber is fluidically separated from said first distribution chamber and from said first mixing chamber.

BRIEF DESCRIPTION OF THE DRAWINGS

For purposes of illustrations and not limitative, some particular embodiments of the present invention will be described with reference to the accompanying drawings, in which.

DETAILED DESCRIPTION OF SOME PREFERRED EMBODIMENTS OF THE PRESENT INVENTION

Figure 1:
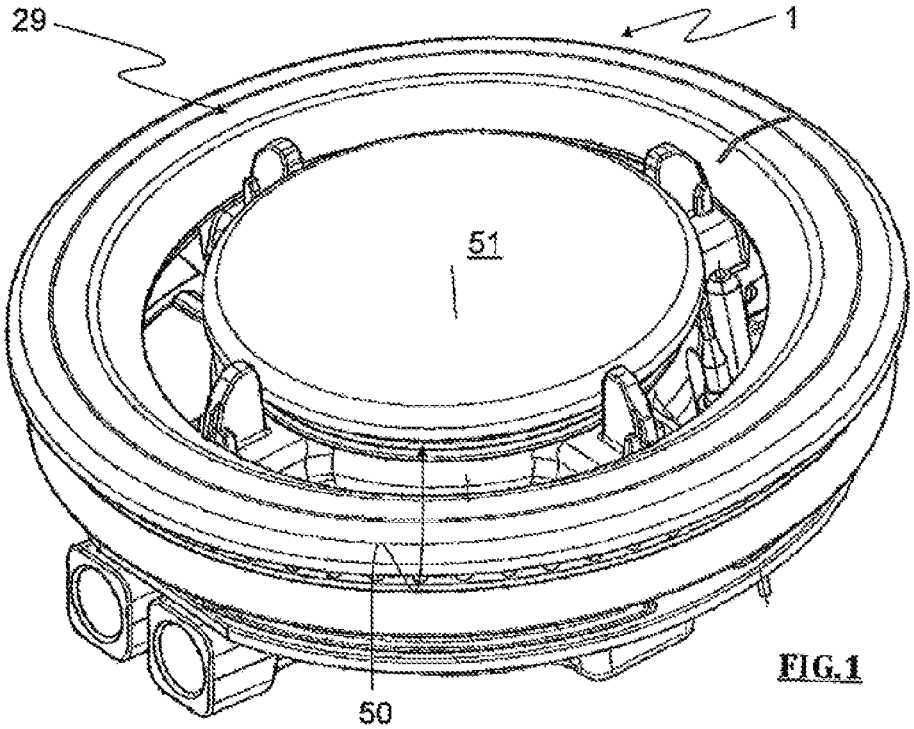
FIG. 1 is an axonometric view of the burner according to the invention.

Referring particularly to such figures, with 1 is shown a burner according to the invention.

Figures from 1 to 3 show a gas burner 1, comprising a cup 2 accommodating an injector 3 for injecting pressurized fuel gas and provided with ducts connecting with the outer environment, and a head 4 coupled to said cup 2 and comprising a distribution chamber 5, in the embodiment herein shown being of a substantially annular type, for at least a first circumferential flame spreader 30 carrying a covering element 29.

In addition, such a burner 1 comprises a first mixing chamber 6, preferably obtained inside the head 4, of the radial Venturi effect type, intended for mixing primary air, coming from the outer environment, and fuel gas, coming from the injector 3, so to set up a fuel mixture being transferred into the distribution chamber 5 by convenient ducts 7. Such a first mixing chamber $ is fluidically connected to the afore said cup 2 through a cylindrical duct 31 and is further fluidically connected to the injector 3, according to the known art.

Particularly, in the burner 1 herein illustrated, the fuel gas, delivered from the injector 3, passes through the duct 31 and the afore said mixing chamber 6, with radial Venturi effect, where it is mixed with the primary air drawn, through the inflow ducts 8, from the outer environment into the cup 2, thanks to the depression caused by the Venturi effect obtained in the mixing chamber 6 itself.

It has to be observed that, although herein a mixing chamber 6 with radial Venturi effect is represented, that is wherein the fluidic mixture expansion upstream the restricted Venturi section is radially obtained in an horizontal chamber, any other chamber type for mixing fuel gas with primary air coming from the outer environment could be alternatively used, for example with axial Venturi effect, without for that falling out from the protection scope herein demanded.

Anyway in such a mixing chamber 6, as known, the mixing of fuel gas with such a primary air is obtained, to form a fuel mixture that, thanks to appropriate transferring ducts 7 present in the first burner 1, is transferred to the distribution chamber 5, from where, coming out from the circumferential flame spreader 30, can be ignited with the contribution of secondary air of the outer environment.

More in detail, the afore said burner 1 comprises four ducts 7 for transferring the fuel mixture from the corresponding mixing chamber 6 to the afore said distribution chamber 5, and four inflow ducts 8 of the primary air from the outer environment, and particularly from over the hob (shown schematically in FIG. 2) the burner 1 is constrained to, inside the cup 2, as well as four corresponding separating elements 9, each of them being used for separating every duct 7 for transferring the fuel mixture from the respective inflow duct 8 of primary air.

More in detail, the inflow ducts 8 of primary air, in the burner 1 herein illustrated presenting an entrance section placed over the hob to which the cup 2 is constrained being built-in, are substantially separated, at least for a length thereof, from the higher transferring ducts 7 of the fuel mixture by such separating elements 9, so that the latter constitute a separating surface between such ducts 7 and 8.

Advantageously, according to the present invention, each separating element 9 is tightly constrained to the head 4 so that to prevent any fluidic communication between the transferring ducts 7 and the inflow ducts 8 of primary air that such a separating element 9 separates.

It has to be observed that with the term "tightly constrained element for separating ducts" is intended that the afore said element for separating the ducts is constrained to the burner, at the surface separating the afore said ducts, in such a way to ensure the fluidic tight of a duct relatively to the other. It has further to be observed that, although the embodiment herein illustrated describes a burner having four transferring ducts 7 and four inflow ducts 8, nevertheless an embodiment with only one transferring and one inflow duct, or any other different number, falls within the protection scope of the present invention. It has also to be specified that the embodiment herein described provides a number of separating elements 9 equal to the number of transferring ducts 7 and inflow ducts 8, nevertheless an embodiment wherein only one separating element is provided, for example cross-shaped, being anyway tightly constrained to the head 2 of the burner, falls again in the protection scope of the present invention.

In addition, although herein not illustrated, each separating element 9 may be tightly constrained to the cup 2 of the burner 1, instead to the head 4, without for that exiting from the protection scope of the present invention.

Figure 4:
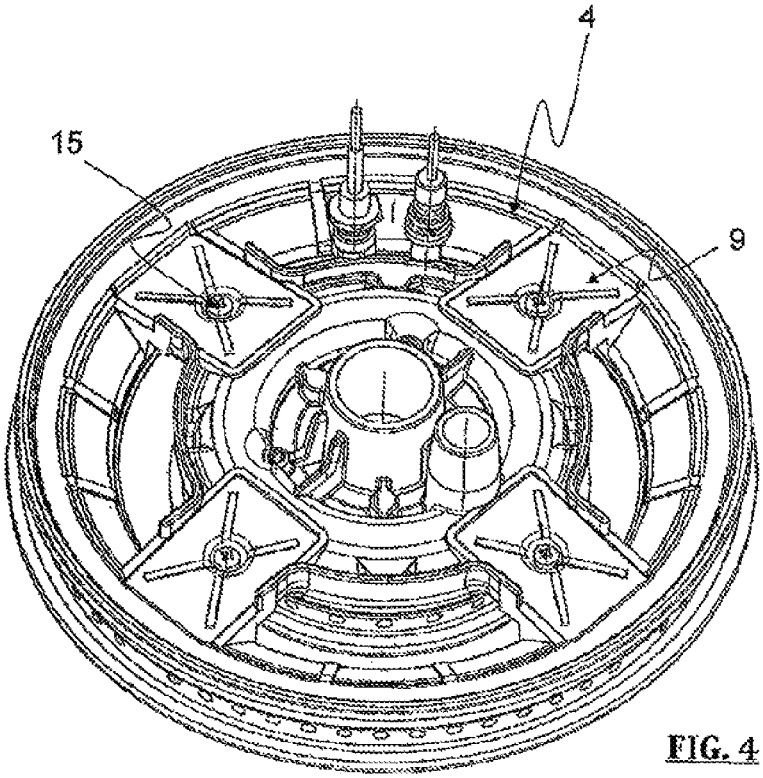
FIG. 4 is a bottom view of the burner head according to figures from 1 to 3.

According to the embodiment herein described, each separating element 9 comprises a plate, having a substantially rectangular shape in plant, that is forced into the retaining walls protrudent below from the head 4 of the burner 1, and delimiting at least partially a corresponding transferring duct 7 of the fuel mixture, and that is further fixed to the head 4 of the burner 1 by a screw 15 screwed onto the same head 4 of the burner 1. That is more easily visible observing the attached FIG. 4, showing a bottom view of the head 3 of the gas burner 1.

This ensures an optimal tight constraining of the plate 9 to the transferring duct 7 and then an efficient fluidic tight of the transferring 7 and inflow 8 ducts then avoiding any leakages of the fuel mixture and/or primary air from a duct to another, along the path such fluids follow inside the burner 1.

It has to be observed that, in the embodiment herein shown, each plate 9, composed of a substantially flat plate, then curved and forced into the seat defined by the afore said retaining walls of the head 4 of the burner, constitutes the lower we of the transferring duct 7 it is constrained to, and it constitutes the higher we as well, or part of the higher wall, of the inflow duct 8 it is associated with.

Figure 5:
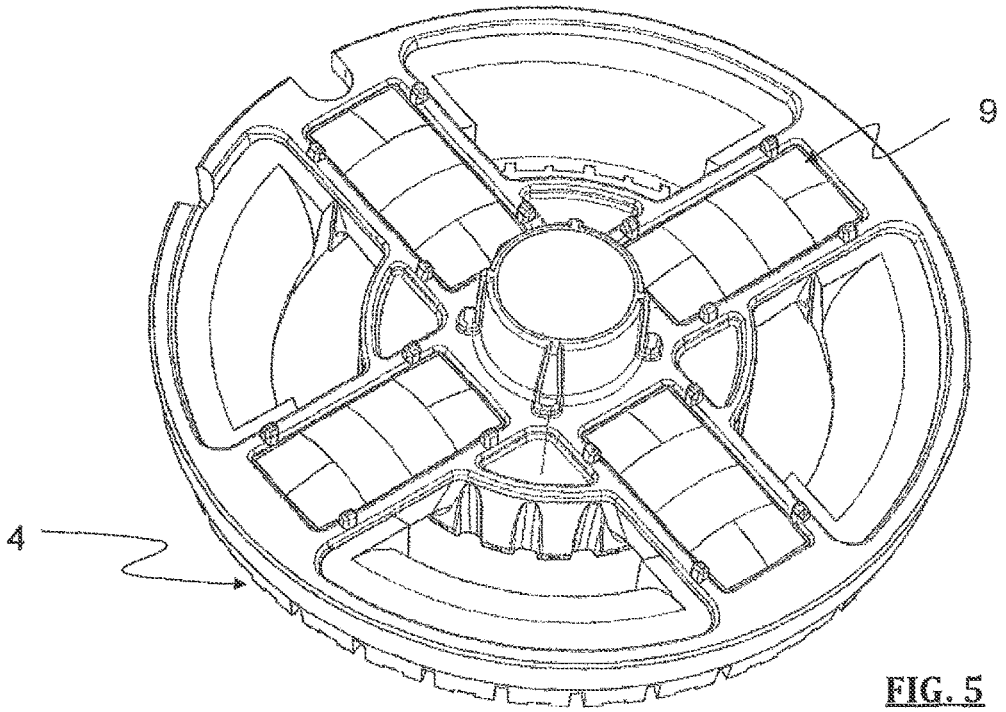
FIG. 5 is a bottom view of the burner head according to a further embodiment of the invention.
Figure 6:
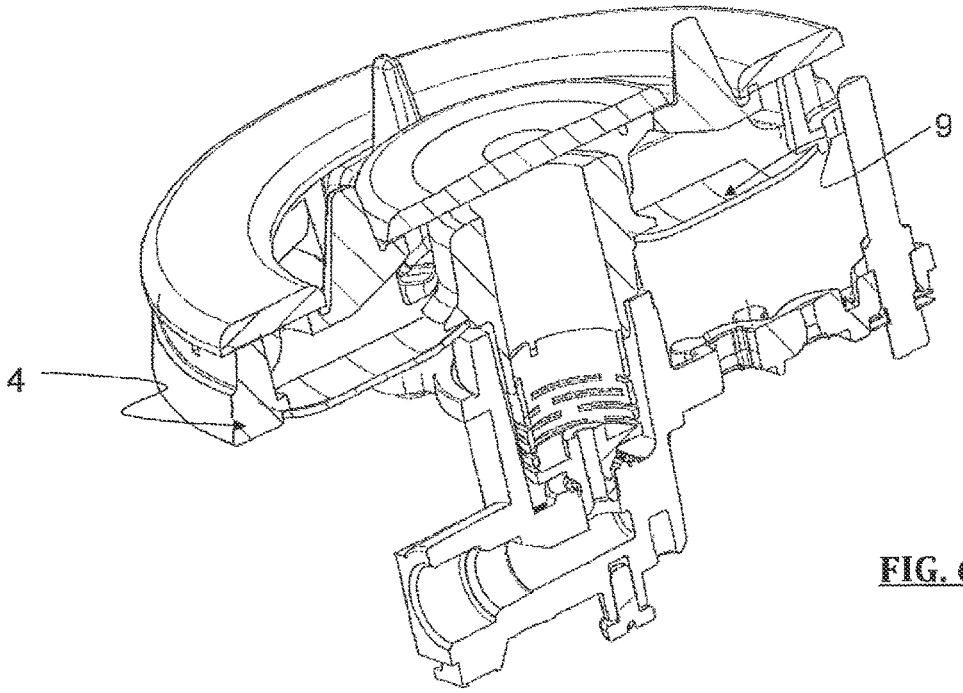
FIG. 6 is a cut-away view of part of the gas burner of FIG. 5.

Alternatively, each separating element 9 may be constrained to the head 4 by simply riveting, or threaded elements, or deformation, or by only interference, or interlocking, as on the other hand shown in a second embodiment of the invention in FIGS. 5 and 6 in attachment, without for that exiting from the protection scope of the present invention, as long as the selected constraining mode ensures a fluidic tightness of the transferring duct 7 relatively to the inflow duct 8 of primary air.

Again, each separating element 9 may be tightly and permanently constrained to the head 4, or cup 2. For example, each separating element may be connected to the head 4, or the cup 2, by welding.

According to a particular aspect of the present invention, each separating element 9 is preferably made of steel and has a substantially rectangular shape in plant, and it is eventually folded during the assembly, and then it may be obtained by a simple sheet shearing.

Figure 2:
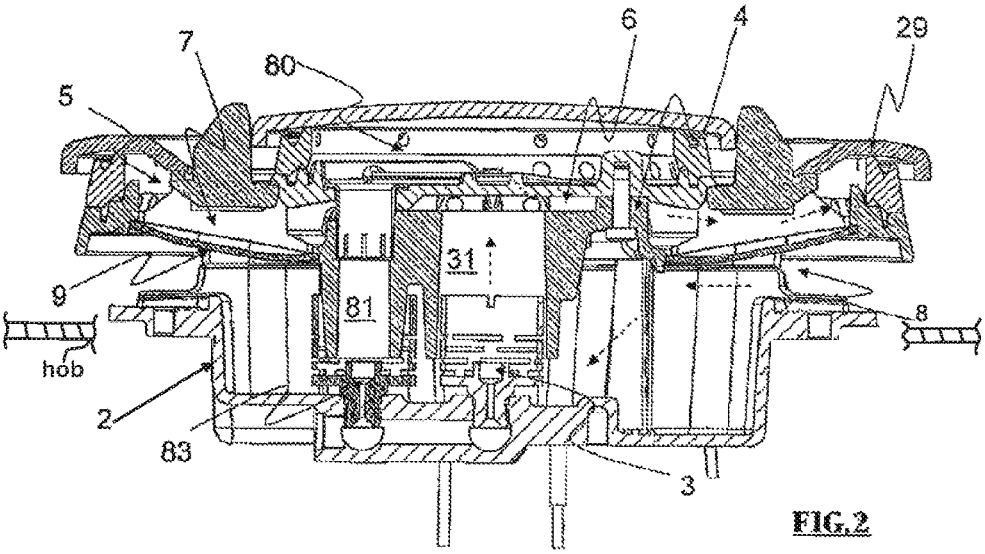
FIG. 2 is a longitudinal section view of the burner according to the invention.
Figure 3:
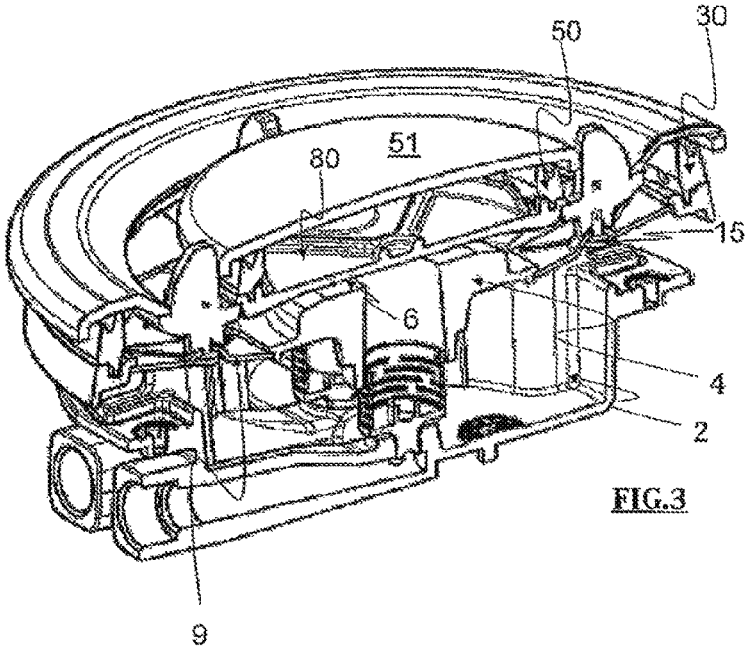
FIG. 3 is a cut-away view of the burner according to the invention along a vertical plane.

Referring to FIG. 2, as mentioned yet, the primary air, fuel gas and fuel mixture path inside the burner 1 (see the dotted arrows) is as follows: the primary air, because of depression caused by the gas injection from the injector 3 into the vertical duct 30 and the mixing chamber 6 with radial Venturi effect, is drawn into the cup 2 from above the corresponding hob, through the inflow ducts 8 (in FIG. 2 for clarity only one inflow duct and only one transferring duct are shown), and then it is dragged by the fuel gas itself into the radial mixing chamber 6. At the end of the mixing chamber 6, the fuel mixture passes through the transferring ducts 7 and then conies into the distribution chamber 5 and it becomes available for the circumferential flame spreader 30.

In addition, in the particular embodiment of the present invention herein shown in figures, the burner 1 comprises a central flame spreader 50 that is assembled too on the head 4 of the burner 1 for defining, with a corresponding covering element 51, a second distribution chamber 80 for said central flame spreader 50, and at least one second mixing chamber 81, of the axial Venturi effect type, with a vertical development, opening at the top into the second distribution chamber 80 and being placed in fluidic communication with the cup 2 and a corresponding second injector 83 for the fuel gas.

More particularly, said second mixing chamber 81 is partially obtained inside the head 4 and partially inside the cup 2 and has a tubular convergent-divergent shape along its vertical axial development.

It has to be observed that the second distribution chamber 80 is directly supplied by the afore said mixing chamber 81, and it is separated from the said first mixing chamber 6 in such a way that the two distribution chambers 8 and 80 are fluidically separated and then they could be separately supplied. Particularly, although the cup 2 defines fluidic paths for the primary air in common with both the mixing chamber 6 with radial Venturi effect and with the mixing chamber 81 with axial Venturi effect, through the inflow ducts 8, the use of two distinct injectors 3, 83 and the fluidic communication absence between the distribution chambers 5 and 80, allow the user to separately specify the mixture inflow to the afore said two distribution chambers 5, 80. It has to be noticed that, although it is herein described a burner provided with two mixing chambers and two distribution chambers fluidically separated, any other burner arrangement comprising the use of transferring ducts of the fuel mixture from a mixing chamber to one or more distribution chambers of the mixture itself to corresponding flame spreaders, falls anyway within the protection scope of the present invention.

Particularly, the gas burners too, provided with only one mixing chamber and two or more distribution chambers fluidically connected one to another with two or more corresponding flame spreaders, as long as they are provided with ducts for transferring the mixture and inflow ducts of primary air separated from the claimed corresponding separating tight elements, fall within the protection scope herein demanded.

The invention claimed is:

1. An atmospheric gas burner comprising:

a cup of the burner accommodating at least one injector for fuel gas, a head of the burner coupled to said cup and comprising at least one distribution chamber for a first circumferential flame spreader, at least one first mixing chamber for mixing primary air and fuel gas to set up a fuel mixture, said at least one first mixing chamber being fluidically connected to said cup and to said at least one injector, at least one transferring duct configured to transfer the fuel mixture from said at least one first mixing chamber into said at least one distribution chamber, at least one inflow duct through which the primary air is drawn from the outer environment into said cup of the burner, and at least one separating element disposed at an opening between said at least one transferring duct of the fuel mixture and said at least one inflow duct of the primary air and providing a partition between said at least one transferring duct of the fuel mixture and said at least one inflow duct of the primary air, wherein said at least one separating element is tightly and permanently constrained to said head or to said cup of the burner to produce a tight seal, wherein the tight seal of said at least one separating element to said head or to said cup prevents fluidic communication through the partition between said at least one transferring duct and said at least one inflow duct, wherein said head or said cup includes protruding retaining walls continuously circumscribing the opening and said at least one separating element includes a plate disposed within the retaining walls.

2. The burner according to claim 1, wherein said at least one separating element comprises at least one plate.

3. The burner according to claim 1, wherein said at least one plate has a substantially rectangular shape.

4. The burner according to claim 1, wherein said at least one separating element is tightly welded to said head or to said cup.

5. An atmospheric gas burner comprising:

a cup of the burner accommodating at least one injector for fuel gas, a head of the burner coupled to said cup and comprising at least one distribution chamber for a first circumferential flame spreader, at least one first mixing chamber for mixing primary air and fuel gas to set up a fuel mixture, said at least one first mixing chamber being fluidically connected to said cup and to said at least one injector, at least one transferring duct configured to transfer the fuel mixture from said at least one first mixing chamber into said at least one distribution chamber, at least one inflow duct through which the primary air is drawn from the outer environment into said cup of the burner, and at least one separating element disposed at an opening between said at least one transferring duct of the fuel mixture and said at least one inflow duct of the primary air and providing a partition between said at least one transferring duct of the fuel mixture and said at least one inflow duct of the primary air, wherein said at least one separating element is tightly and permanently constrained to said head or to said cup of the burner to produce a tight seal, wherein the fight seal of said at least one separating element to said head or to said cup prevents fluidic communication through the partition between said at least one transferring duct and said at least one inflow duct, wherein said head or said cup includes protruding retaining walls continuously circumscribing the opening and said at least one separating element includes a plate disposed within the retaining walls.

6. The burner according to claim 5, wherein said at least one separating element is removably constrained to said head, or said cup.

7. The burner according to claim 6, wherein said at least one separating element is constrained by riveting, or by threaded elements, to said head, or said cup.

8. The burner according to claim 1, wherein said at least one separating element is obtained from a metallic material selected from steel and aluminum.

9. The burner according to claim 1, wherein said at least one separating element is obtained by shearing.

10. The burner according to claim 1, comprising a central flame spreader combinable with said burner head to define at least one second distribution chamber for said central flame spreader.

11. The burner according to claim 10, wherein said at least one second distribution chamber is fluidically connected to a second mixing chamber and a corresponding injector.

12. The burner according to claim 10, wherein said at least one second distribution chamber and said first distribution chamber are connected to separate mixing chambers.

13. The burner according to claim 1, wherein said at least one inflow duct of the primary air has an entrance section disposed over the hob the burner is fixed thereto.

14. The burner according to claim 11, wherein said separating element is tightly constrained to said second mixing chamber.

15. The burner according to claim 1, wherein said at least one mixing chamber has a radial Venturi effect.

16. The burner according to claim 1, wherein said at least one mixing chamber has an axial Venturi effect.

17. The burner according to claim 1, wherein said distribution chamber for a first circumferential flame spreader is substantially annular.

18. The burner according to claim 5, wherein said at least one separating element is constrained by interference or interlocking to said head, or said cup.

19. The burner according to claim 5, wherein sad plate has a substantially rectangular shape.

* * * * *